US006720939B2

(12) United States Patent
Watabu

(10) Patent No.: US 6,720,939 B2
(45) Date of Patent: Apr. 13, 2004

(54) DISPLAY DEVICE

(75) Inventor: Kazuyoshi Watabu, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 64 days.

(21) Appl. No.: 09/859,453

(22) Filed: May 18, 2001

(65) Prior Publication Data

US 2002/0000954 A1 Jan. 3, 2002

(30) Foreign Application Priority Data

Jun. 30, 2000 (JP) ..... P2000-198284

(51) Int. Cl.[7] ..... G09G 3/28
(52) U.S. Cl. ..... 345/60; 345/68
(58) Field of Search ..... 345/42, 211, 67, 345/68, 60–69; 315/169.1; 313/582, 589, 586

(56) References Cited

U.S. PATENT DOCUMENTS

| | | | | |
|---|---|---|---|---|
| 5,307,085 A | | 4/1994 | Nakamura | 345/99 |
| 6,172,659 B1 | * | 1/2001 | Kim | 345/42 |
| 6,344,841 B1 | * | 2/2002 | Moon | 345/60 |
| 6,373,452 B1 | * | 4/2002 | Ishii et al. | 345/67 |
| 6,384,802 B1 | * | 5/2002 | Moon | 345/60 |
| 2002/0011800 A1 | * | 1/2002 | Schermerhorn et al. | 315/169.4 |
| 2002/0070928 A1 | * | 6/2002 | Awamoto et al. | 345/204 |

FOREIGN PATENT DOCUMENTS

| | | | | |
|---|---|---|---|---|
| GB | 2326511 A | * | 12/1998 | G09G/03/28 |
| JP | 6-004039 A1 | | 1/1994 | |
| JP | 8-305319 A1 | | 11/1996 | |
| JP | B2-2894039 | | 3/1999 | |

* cited by examiner

*Primary Examiner*—Vijay Shankar
*Assistant Examiner*—Nitin Patel
(74) *Attorney, Agent, or Firm*—Birch, Stewart, Kolasch & Birch, LLP

(57) ABSTRACT

Address electrodes (3) belonging to the i-th cluster are connected to an address electrode driving circuit (5*i*), address electrodes (3) belonging to the j-th cluster are connected to an address electrode driving circuit (5*j*), address electrodes (3) belonging to the k-th cluster are connected to an address electrode driving circuit (5*k*) and address electrodes (3) belonging to the l-th cluster are connected to an address electrode driving circuit (5*l*). Transfer data (Di to Dl) are outputted from a signal processing circuit (7) with their respective phases varied by, e.g., one clock of the system clock. Similarly, transfer clocks (TCi to TCl) are outputted from the signal processing circuit (7) with their respective phases varied by, e.g., one clock of the system clock. With this constitution, it becomes possible to provide a display device which can prevent transition of a plurality of digital signals at the same timing to suppress generation of electromagnetic waves and magnetic fields which would be caused thereby.

18 Claims, 13 Drawing Sheets

DISPLAY DEVICE

BACKGROUND OF THE INVENTION

1. Field of the Invention

The present invention relates to a display device comprising a display panel such as a plasma display panel (hereinafter, referred to as "PDP") and a driving circuit for driving the display panel.

2. Description of the Background Art

A display device will be discussed below, taking a case of a plasma display device as an example. FIG. 14 is a block diagram showing a constitution of a plasma display device in the background art (see U.S. Pat. No. 2,894,039). A display panel 101 comprises a plurality of scan electrodes 102 extending in a first direction, common electrodes (not shown) which are paired with the scan electrodes 102, respectively, and a plurality of address electrodes 103 separated from the scan electrodes 102 and the common electrodes, extending in a second direction perpendicular to the first direction.

The scan electrodes 102 are connected to a scan electrode driving circuit 104. The address electrodes 103 are divided into four clusters in accordance with the positions in the display panel 101. A plurality of address electrodes 103 belonging to the cluster corresponding to the leftmost quarter region of an image are connected to an address electrode driving circuit 105*i*. A plurality of address electrodes 103 belonging to the cluster corresponding to the left-center quarter region of the image are connected to an address electrode driving circuit 105*j*. A plurality of address electrodes 103 belonging to the cluster corresponding to the right-center quarter region of the image are connected to an address electrode driving circuit 105*k*. A plurality of address electrodes 103 belonging to the cluster corresponding to the rightmost quarter region of the image are connected to an address electrode driving circuit 105*l*.

The scan electrode driving circuit 104 and the address electrode driving circuits 105*i* to 105*l* are connected to a control circuit 106. Further, the address electrode driving circuits 105*i* to 105*l* are connected to a signal processing circuit 107. The address electrode driving circuits 105*i* to 105*l* each have a shift register (not shown) therein. The signal processing circuit 107 is connected to the control circuit 106.

The control circuit 106 receives a synchronizing signal from the outside and outputs a scan electrode driving control signal S1, a transfer data determination signal S2, a transfer clock TC and a signal processing control signal S3. The signal processing circuit 107 receives a video signal from the outside and the signal processing control signal S3 from the control circuit 106 and outputs transfer data Di to Dl which are digital data.

The transfer data determination signal S2 and the transfer clock TC are commonly inputted to the address electrode driving circuits 105*i* to 105*l* from the control circuit 106. Further, the transfer data Di to Dl of the same phase are inputted to the address electrode driving circuits 105*i* to 105*l*, respectively, from the signal processing circuit 107.

Thus, in the background-art plasma display device, the address electrodes 103 are divided into a plurality of clusters in accordance with the positions in the display panel 101 and the address electrode driving circuits 105*i* to 105*l* are provided correspondingly to the respective clusters of the address electrodes 103. Therefore, it is possible to transmit the transfer data Di to Dl in parallel to the address electrode driving circuits 105*i* to 105*l* from the signal processing circuit 107. Accordingly, it becomes possible to lower the speed of data transmission to the shift register in the address electrode driving circuit as compared with a plasma display device in which the address electrodes 103 are not divided into a plurality of clusters and the transfer data are transmitted in series to a single address electrode driving circuit from the signal processing circuit.

In the background-art plasma display device, however, the transfer data Di to Dl of the same phase are outputted from the signal processing circuit 107 and then the transfer data Di to Dl are stored in the shift registers of the address electrode driving circuits 105*i* to 105*l*, respectively, on the basis of the common transfer clock TC.

Therefore, a large amount of electromagnetic waves and magnetic fields are generated due to the transition of a plurality of digital data having the same phase at the same timing, which cause noises in a display image and affect other devices and circuits. For this reason, a tight electromagnetic shield is needed in the display device, which causes a rise in cost.

SUMMARY OF THE INVENTION

The present invention is directed to a display device. According to a first aspect of the present invention, the display device comprises: a display panel having a plurality of scan electrodes extending in a first direction and a plurality of address electrodes separated from the plurality of scan electrodes, extending in a second direction perpendicular to the first direction; a plurality of address electrode driving circuits connected to the plurality of address electrodes; and a signal processing circuit connected to the plurality of address electrode driving circuits, and in the display device of the first aspect, the plurality of address electrodes are divided into a plurality of clusters, the plurality of address electrode driving circuits are provided correspondingly to the plurality of clusters of the address electrodes and include a first and a second address electrode driving circuits, and digital data transmitted from the signal processing circuit to the first address electrode driving circuit and digital data transmitted from the signal processing circuit to the second address electrode driving circuit are different in phase from each other.

According to a second aspect of the present invention, in the display device, the plurality of address electrodes are divided into m (m is an integer, not less than two) clusters, the plurality of address electrode driving circuits are m address electrode driving circuits, and the digital data transmitted from the signal processing circuit to the m address electrode driving circuits are different in phase from one another.

According to a third aspect of the present invention, in the display device, the plurality of address electrodes are divided into m (m is an integer, not less than two) clusters, the plurality of address electrode driving circuits are m address electrode driving circuits, the m address electrode driving circuits are divided into n (n is an integer, not less than two and not more than m−1) groups, and the digital data inputted to one or a plurality of address electrode driving circuits belonging to same group are equivalent in phase to one another and the digital data inputted to a plurality of address electrode driving circuits belonging to different groups are different in phase from one another.

According to a fourth aspect of the present invention, in the display device, the signal processing circuit has a first register temporarily storing first digital data transmitted to the first address electrode driving circuit; a second register temporarily storing second digital data transmitted to the second address electrode driving circuit; a first delay element for delaying the first digital data outputted from the first register by a predetermined time and inputting the first digital data into the first address electrode driving circuit; and a second delay element for delaying the second digital data outputted from the second register by a time different from the predetermined time and inputting the second digital data into the second address electrode driving circuit.

According to a fifth aspect of the present invention, in the display device of any one of the first to fourth aspects, the plurality of scan electrodes include a plurality of first scan electrodes provided in a first region of the display panel and a plurality of second scan electrodes provided in a second region of the display panel, and the display device further comprises: a first scan electrode driving circuit connected to the plurality of first scan electrodes; a second scan electrode driving circuit connected to the plurality of second scan electrodes; and a control circuit connected to the first and second scan electrode driving circuits. In the display device of the fifth aspect, an addressing period during which an addressing operation is performed to select a cell which should be illuminated and a discharge sustain period during which a discharge for luminescence is generated on the cell which is selected by the addressing operation are repeated to perform a display operation in one field of display, and the discharge sustain period for the display operation in the first region and the discharge sustain period for the display operation in the second region do not overlap each other by the control circuit controlling the first and second scan electrode driving circuits.

According to a sixth aspect of the present invention, the display device comprises: a display panel having a plurality of first scan electrodes extending in a first direction in a first region of the display panel, a plurality of second scan electrodes extending in the first direction in a second region of the display panel and a plurality of address electrodes separated from the plurality of first and second scan electrodes, extending in a second direction perpendicular to the first direction; a first scan electrode driving circuit connected to the plurality of first scan electrodes; a second scan electrode driving circuit connected to the plurality of second scan electrodes; and a control circuit connected to the first and second scan electrode driving circuits. In the display device of the sixth aspect, an addressing period during which an addressing operation is performed to select a cell which should be illuminated and a discharge sustain period during which a discharge for luminescence is generated on the cell which is selected by the addressing operation are repeated to perform a display operation in one field of display, and the discharge sustain period for the display operation in the first region and the discharge sustain period for the display operation in the second region do not overlap each other by the control circuit controlling the first and second scan electrode driving circuits.

In the plasma display device of the first aspect of the present invention, it is possible to suppress generation of electromagnetic waves and magnetic fields caused by the transition of a plurality of digital data having the same phase at the same timing.

In the plasma display device of the second aspect of the present invention, by varying all the phases of respective digital data transmitted to the m address electrode driving circuits, it is possible to enhance the effect of suppressing generation of electromagnetic waves and magnetic fields to the maximum.

In the plasma display device of the third aspect of the present invention, since a plurality of address electrode driving circuits belonging to one group handle digital data of the same phase, it is possible to reduce the delay time of the data output when the phases of the digital data are varied by delay.

In the plasma display device of the fourth aspect of the present invention, with a simple constitution using well-known registers and delay elements, it is possible to obtain a plurality of digital data outputted from the signal processing circuit with phases varied from one to another.

In the plasma display device of the fifth aspect of the present invention, it is possible to disperse the discharge sustain operation which accounts for most of the power consumption in the display device.

In the plasma display device of the sixth aspect of the present invention, it is possible to disperse the discharge sustain operation which accounts for most of the power consumption in the display device.

The present invention relates to a display device which is provided with address electrode driving circuits correspondingly to a plurality of clusters of address electrodes, and an object of the present invention is to provide a display device which can prevent transition of a plurality of digital signals at the same timing to suppress generation of electromagnetic waves and magnetic fields which would be caused thereby.

These and other objects, features, aspects and advantages of the present invention will become more apparent from the following detailed description of the present invention when taken in conjunction with the accompanying drawings.

DESCRIPTION OF THE PREFERRED EMBODIMENTS

The First Preferred Embodiment

Figure 1:
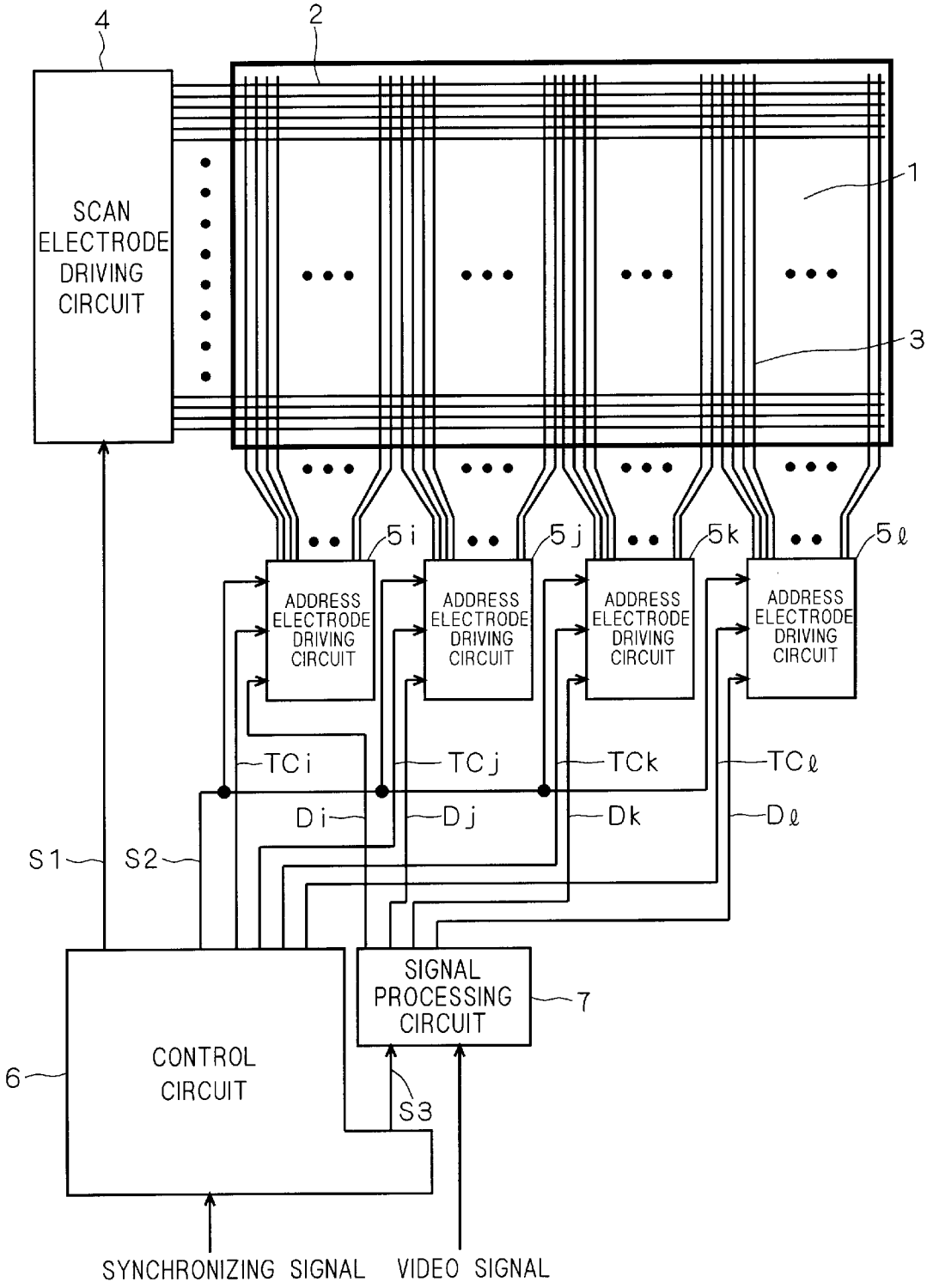
FIG. 1 is a block diagram showing a constitution of a plasma display device in accordance with a first preferred embodiment of the present invention.

FIG. 1 is a block diagram showing a constitution of a plasma display device in accordance with the first preferred embodiment of the present invention. A display panel 1 comprises a plurality of scan electrodes 2 extending in the first direction, common electrodes (not shown) which are paired with the scan electrodes 2, and a plurality of address electrodes 3 respectively separated from the scan electrodes 2 and the common electrodes, extending in the second direction perpendicular to the first direction. The scan electrodes 2 are respectively connected to the outputs of a scan electrode driving circuit 4.

The address electrodes 3 are divided into a plurality of clusters (four clusters in the case of FIG. 1) in accordance with the positions in the display panel 1. In the case of FIG. 1 a plurality of address electrodes 3 in the leftmost quarter region of the display panel 1 are connected to an address electrode driving circuit 5*i* as the address electrodes belonging to the leftmost quarter cluster. A plurality of address electrodes 3 in the left-center quarter region of the display panel 1 are connected to an address electrode driving circuit 5*j* as the address electrodes belonging to the left-center quarter cluster. A plurality of address electrodes 3 in the right-center quarter region of the display panel 1 are connected to an address electrode driving circuit 5*k* as the address electrodes belonging to the right-center quarter cluster. A plurality of address electrodes 3 in the rightmost quarter region of the display panel 1 are connected to an address electrode driving circuit 5*l* as the address electrodes belonging to the rightmost quarter cluster.

The scan electrode driving circuit 4 and the address electrode driving circuits 5*i* to 5*l* are connected to a control circuit 6. Further, the address electrode driving circuits 5*i* to 5*l* are connected to a signal processing circuit 7. The address electrode driving circuits 5*i* to 5*l* each have a register (not shown) therein. The signal processing circuit 7 is connected to the control circuit 6.

The control circuit 6 receives the synchronizing signal from the outside and outputs the scan electrode driving control signal S1, the transfer data determination signal S2, transfer clocks TCi to TCl, and the signal processing control signal S3. The signal processing circuit 7 receives the video signal from the outside and the signal processing control signal S3 from the control circuit 6 and outputs transfer data Di to Dl which are digital data.

The transfer data determination signal S2 is commonly inputted to the address electrode driving circuits 5*i* to 5*l* from the control circuit 6. The scan electrode driving control signal S1 is inputted to the scan electrode driving circuit 4 from the control circuit 6. The transfer clock TCi is inputted to the address electrode driving circuit 5*i*, the transfer clock TCj is inputted to the address electrode driving circuit 5*j*, the transfer clock TCk is inputted to the address electrode driving circuit 5*k* and the transfer clock TCl is inputted to the address electrode driving circuit 5*l*, all from the control circuit 6. Further, the transfer data Di is inputted to the address electrode driving circuit 5*i*, the transfer data Dj is inputted to the address electrode driving circuit 5*j*, the transfer data Dk is inputted to the address electrode driving circuit 5*k* and the transfer data Dl is inputted to the address electrode driving circuit 5*l*, all from the signal processing circuit 7.

Figure 2:
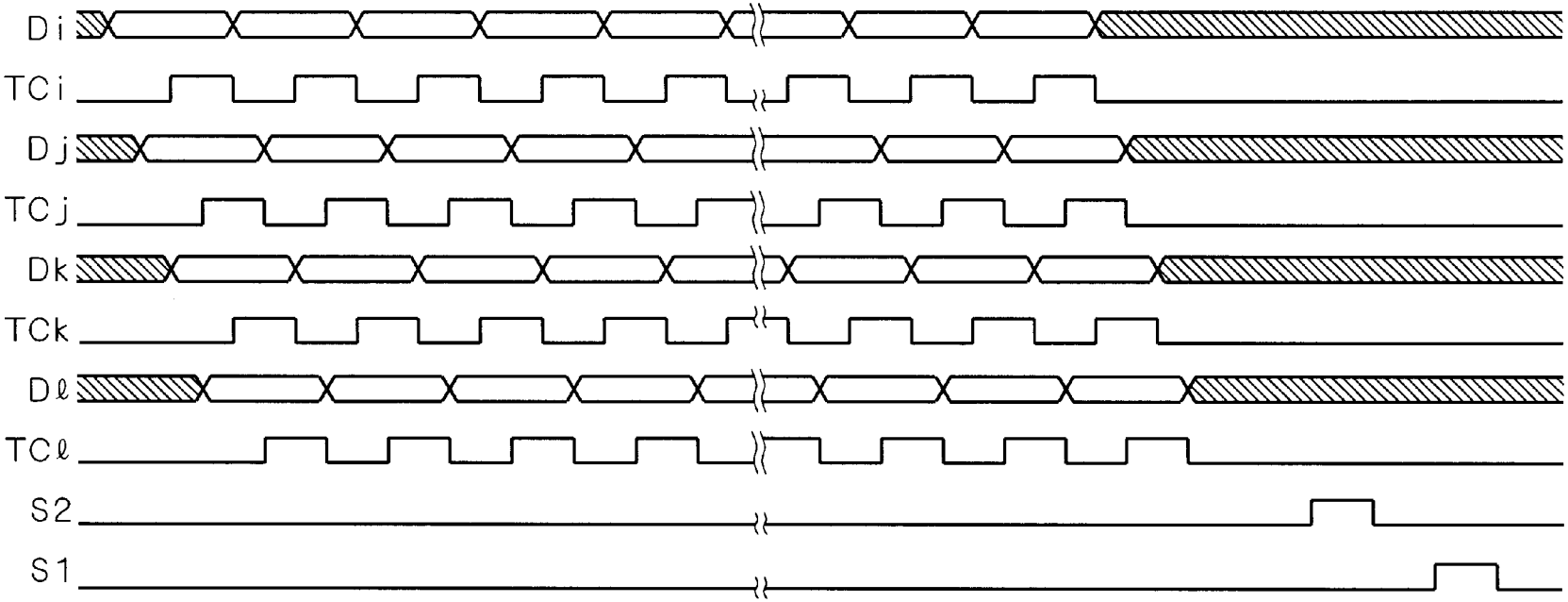
FIG. 2 is a timing chart showing waveforms of transfer data, transfer clocks, a transfer data determination signal and a scan electrode driving control signal.

FIG. 2 is a timing chart showing waveforms of the transfer data Di to Dl, the transfer clocks TCi to TCl, the transfer data determination signal S2 and the scan electrode driving control signal S1. As shown in FIG. 2, the transfer data Di to Dl are outputted from the signal processing circuit 7 with their respective phases varied by, e.g., one clock of the system clock. Similarly, the transfer clocks TCi to TCl are outputted from the control circuit 6 with their respective phases varied by, e.g., one clock of the system clock.

The plasma display device of the present invention adopts a subfield tone display system in which one field of display is divided into a plurality of subfields which are different from one another in the number of discharge sustain pulses, to represent tones. Each subfield includes an addressing period during which an addressing operation is performed to select a discharge cell which should be illuminated among a plurality of discharge cells arranged in matrix in the display panel 1 and a discharge sustain period during which a discharge sustain operation for luminescence is performed on the discharge cell which is selected in the addressing operation.

In the addressing operation, the scan electrode driving circuit 4 sequentially applies a voltage to a plurality of scan electrodes 2 on the basis of the scan electrode driving control signal S1 inputted from the control circuit 6. With this application of voltage, the signal processing circuit 7 converts the video signal into the transfer data Di to Dl and outputs these data on the basis of the signal processing control signal S3 inputted from the control circuit 6. The address electrode driving circuits 5*i* to 5*l* stores the transfer data Di to Dl transmitted from the signal processing circuit 7 to their respective internal registers on the basis of the transfer clocks TCi to TCl transmitted from the control circuit 6, more specifically, on the basis of rise timings of the respective waveforms of the transfer clocks TCi to TCl. Further, the address electrode driving circuits 5*i* to 5*l* receive the transfer data determination signal S2 from the control circuit 6 and apply a predetermined voltage to desired ones of a plurality of address electrodes 3 belonging to the respective clusters, which are specified by the transfer data Di to Dl, respectively.

Through the above operation, discharge cells existing at the intersections of the scan electrode 2 to which the voltage is applied by the scan electrode driving circuit 4 at a certain timing and the address electrodes 3 to which the voltage is applied by the address electrode driving circuits 5*i* to 5*l* at that timing are selected as those which should be illuminated, to which wall charges are applied by the discharge between the scan electrode 2 and the address electrodes 3.

Further, in the discharge sustain operation with a predetermined voltage applied to the not-shown common electrodes, the scan electrode driving circuit 4 applies a voltage to a plurality of scan electrodes 2 on the basis of the scan electrode driving control signal S1 transmitted from the control circuit 6. With this application of voltage, in the discharge cells which are selected in the addressing operation and given the wall charges, the discharges are generated between the scan electrodes 2 and the common electrodes to cause luminescence.

Thus, in the plasma display device of the first preferred embodiment, the transfer data Di to Dl are outputted from the signal processing circuit 7 with their respective phases varied from one to another and stored in the respective internal registers of the address electrode driving circuits 5*i* to 5*l* in response to the transfer clocks TCi to TCl which are different in phase from one another in the addressing operation. Therefore, it becomes possible to suppress the generation of the electromagnetic waves and magnetic fields which would be caused by the transition of a plurality of digital signals at a timing to about one-fourth as compared with the background-art plasma display device.

Further, though the above discussion has been made on the case where a plurality address electrodes 3 are divided into four clusters, the invention in accordance with the first preferred embodiment can be applied to any case where the address electrodes 3 are divided into two or more.

The Second Preferred Embodiment

Figure 3:
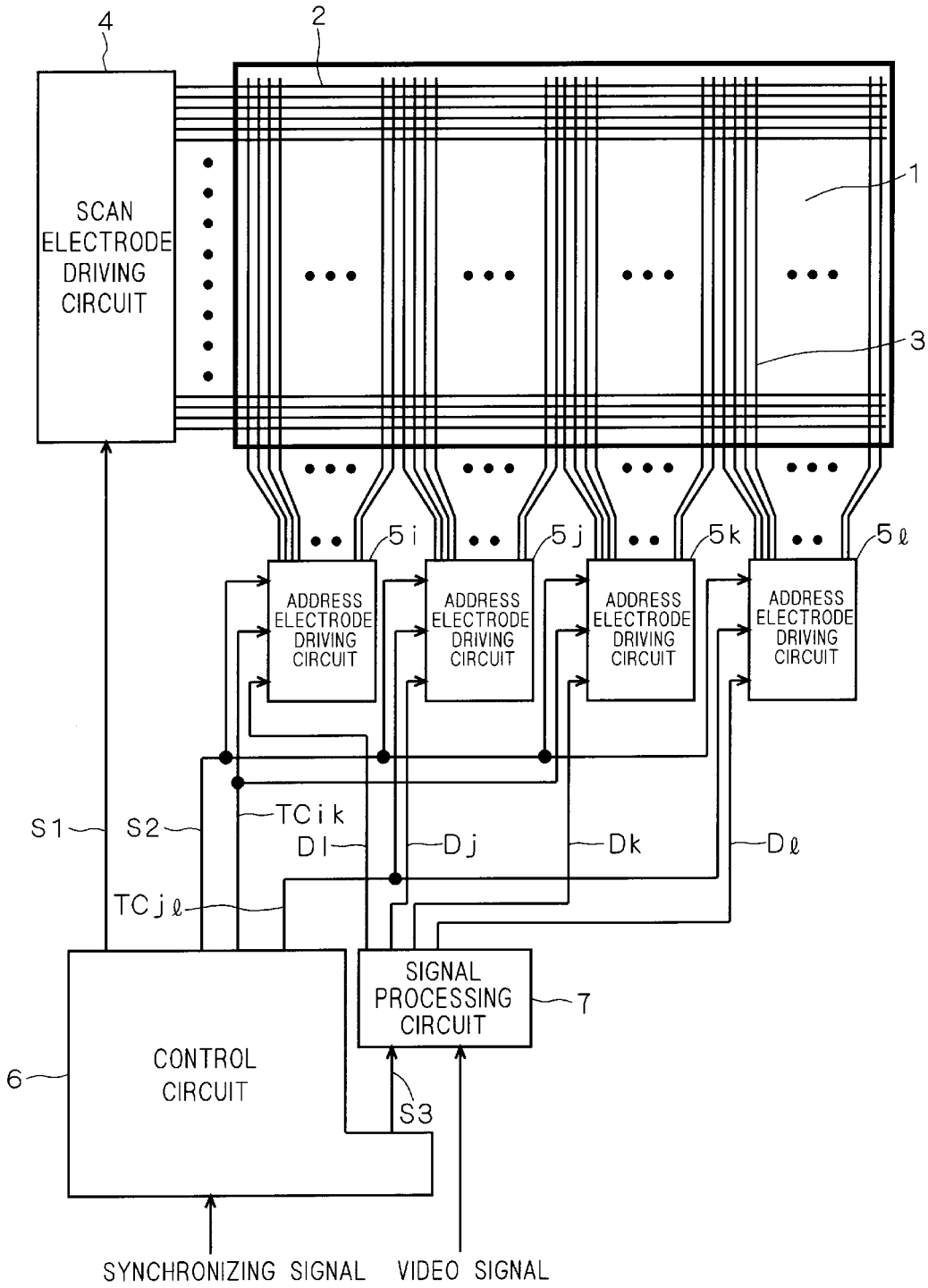
FIG. 3 is a block diagram showing a constitution of a plasma display device in accordance with a second preferred embodiment of the present invention.

FIG. 3 is a block diagram showing a constitution of a plasma display device in accordance with the second preferred embodiment of the present invention. Like in the plasma display device of the first preferred embodiment, the address electrodes 3 are divided into four clusters, a plurality of address electrodes 3 belonging to the leftmost quarter cluster are connected to the address electrode driving circuit 5*i*, a plurality of address electrodes 3 belonging to the left-center quarter cluster are connected to the address electrode driving circuit 5*j*, a plurality of address electrodes 3 belonging to the right-center quarter cluster are connected to the address electrode driving circuit 5*k* and a plurality of address electrodes 3 belonging to the rightmost quarter cluster are connected to the address electrode driving circuit 5*l*.

The address electrode driving circuits 5*i* and 5*k* are classified as those belonging to a first group, to which a transfer clock TCik is commonly inputted from the control circuit 6. The address electrode driving circuits 5*j* and 5*l* are classified as those belonging to a second group, to which a transfer clock TCjl is commonly inputted from the control circuit 6.

Figure 4:
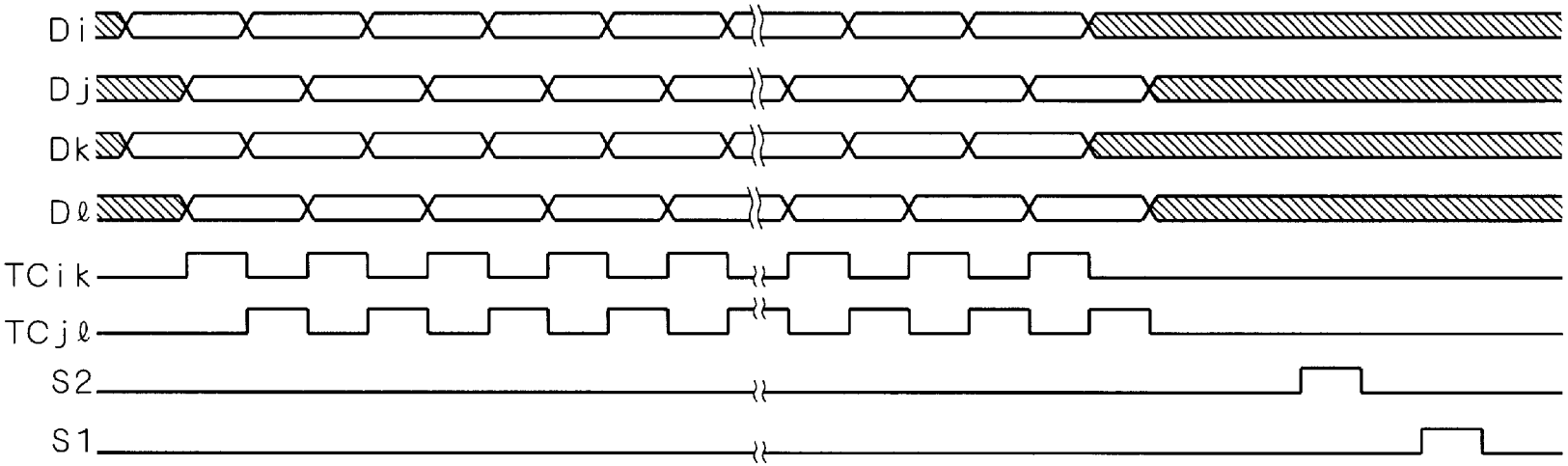
FIG. 4 is a timing chart showing waveforms of transfer data, transfer clocks, a transfer data determination signal and a scan electrode driving control signal.

FIG. 4 is a timing chart showing waveforms of the transfer data Di to Dl, the transfer clocks TCik and TCjl, the transfer data determination signal S2, and the scan electrode driving control signal S1. As shown in FIG. 4, the transfer data Di and Dk are outputted from the signal processing circuit 7 with the same phase, and the transfer data Dj and Dl are outputted from the signal processing circuit 7 with the same phase. Further, the transfer data Di and Dk and the transfer data Dj and Dl are outputted from the signal processing circuit 7 with the respective phases varied from each other. Furthermore, the transfer clock TCik is outputted from the signal processing circuit 7 with the same phase as that of the transfer data Di and Dk, and the transfer clock TCjl is outputted from the signal processing circuit 7 with the same phase as that of the transfer data Dj and Dl. The phases of the transfer clocks TCik and TCjl are different from each other by 180 degrees.

Other constitution and operation of the plasma display device in accordance with the second preferred embodiment are equivalent to those of the plasma display device in accordance with the first preferred embodiment shown in FIGS. 1 and 2.

Thus, in the plasma display device of the second preferred embodiment, the four divided address electrode driving circuits 5*i* to 5*l* are classified into the first groups to which the address electrode driving circuits 5*i* and 5*k* belong and the second group to which the address electrode driving circuits 5*j* and 5*l* belong, and the address electrode driving circuits belonging to the same group handle the transfer data and the transfer clock of the same phase. Therefore, while the transfer data Di to Dl have to be outputted from the signal processing circuit 7 at four different timings in the plasma display device of the first preferred embodiment, these data have only to be outputted at two different timings and it is thereby possible to reduce the delay time of data output in the plasma display device of the second preferred embodiment. As a result, as compared with the plasma display device of the first preferred embodiment, the total time for data transmission from the signal processing circuit 7 to the address electrode driving circuits 5*i* to 5*l* can be reduced, and deterioration in tone quality of display image which would be caused by long addressing period can be avoided.

Further, though the above discussion has been made on the case where a plurality address electrodes 3 are divided into four clusters and the address electrode driving circuits 5*i* to 5*l* are classified into two groups, the invention in accordance with the second preferred embodiment can be applied to any case where the address electrodes 3 are divided by an integer m which is not less than three and the address electrode driving circuits 5*i* to 5*l* are classified into not less than two and not more than (m−1).

The Third Preferred Embodiment

Figure 5:
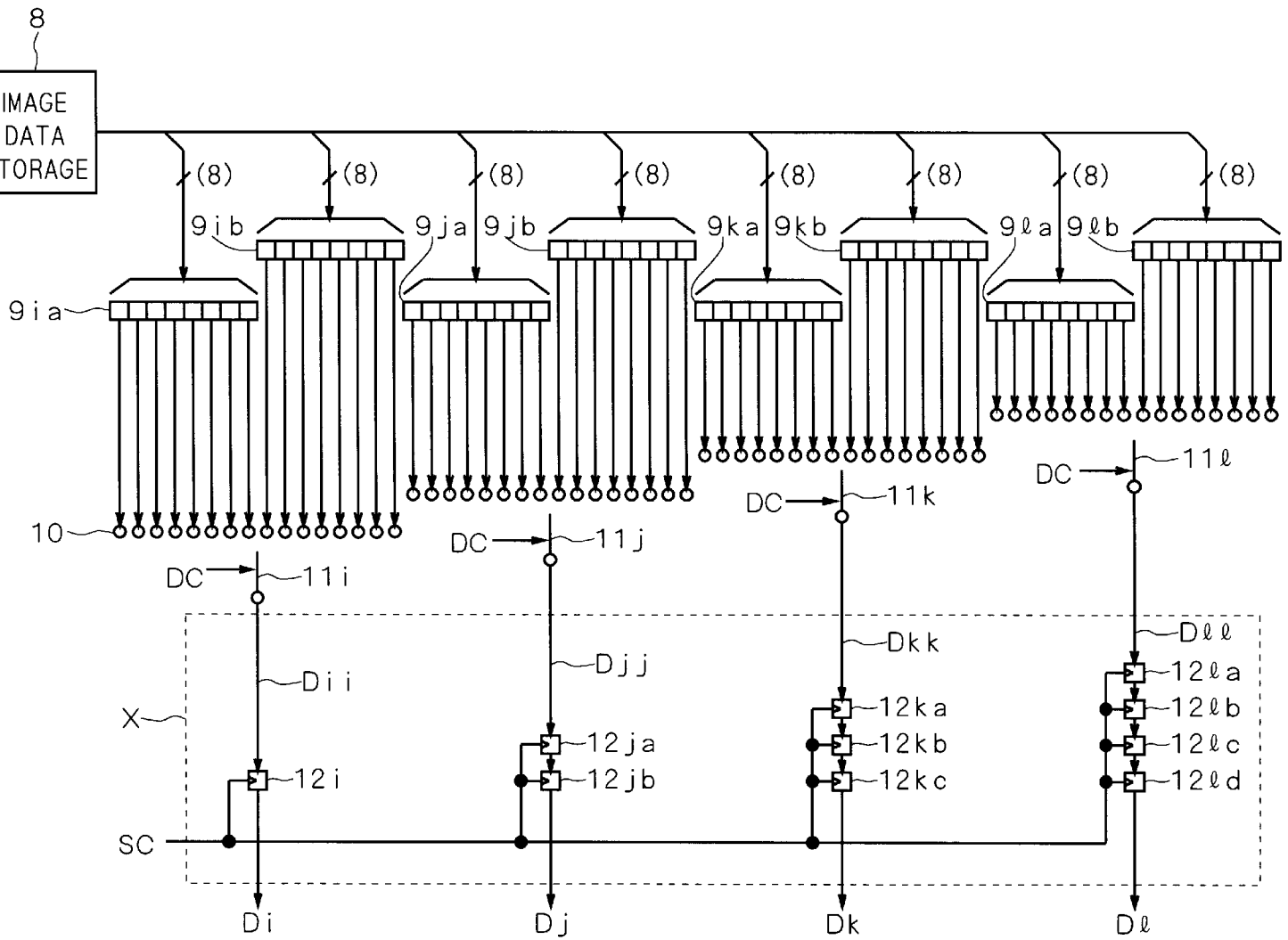
FIG. 5 is a block diagram showing a specific configuration of the signal processing circuit of FIG. 1.

FIG. 5 is a block diagram showing a specific configuration of the signal processing circuit 7 of FIG. 1. In particular, FIG. 5 shows an output portion of the signal processing circuit 7. Further, it is assumed that one scan electrode 2 includes sixty-four discharge cells and each cluster (i, j, k, and l) includes sixteen address electrodes 3. An image data storage 8 is made of semiconductor memory and outputs 8-bit digital data as one unit.

The image data storage 8 is connected to a total of sixty-four registers 9*ia* to 9*la* and 9*ib* to 9*lb* corresponding to sixty-four address electrodes 3, respectively. The registers 9*ia* and 9*ib* are provided correspondingly to the address electrodes 3 belonging to the leftmost quarter cluster, the registers 9*ja* and 9*jb* are provided correspondingly to the address electrodes 3 belonging to the left-center quarter cluster, the registers 9*ka* and 9*kb* are provided correspondingly to the address electrodes 3 belonging to the right-center quarter cluster and the registers 9*la* and 9*lb* are provided correspondingly to the address electrodes 3 belonging to the rightmost quarter cluster.

The registers 9*ia* to 9*la* and 9*ib* to 9*lb* are connected to sixty-four terminals 10, respectively. A selector switch 11*i* can select any one of the sixteen terminals 10 in total connected to the registers 9*ia* and 9*ib*. A selector switch 11*j* can select any one of the sixteen terminals 10 in total connected to the registers 9*ja* and 9*jb*. A selector switch 11*k* can select any one of the sixteen terminals 10 in total connected to the registers 9*ka* and 9*kb*. A selector switch 11*l* can select any one of the sixteen terminals 10 in total connected to the registers 9*la* and 9*lb*.

The selector switch 11*i* is connected to a D-type flip-flop (DFF) 12*i*, the selector switch 11*j* is connected in series to two DFFs 12*ja* and 12*jb*, the selector switch 11*k* is connected in series to three DFFs 12*ka* to 12*kc* and the selector switch 11*l* is connected in series to four DFFs 12*la* to 12*ld*.

The video signal inputted from the outside to the signal processing circuit 7 is converted into a data form suitable for the addressing operation and then temporarily stored in the image data storage 8. The data stored in the image data storage 8 are divided and inputted to the registers 9*ia* to 9*la* and 9*ib* to 9*lb* in accordance with the display position in the display panel 1, and the registers 9*ia* to 9*la* and 9*ib* to 9*lb* hold the inputted data. At the same time when the next data are inputted to the registers 9*ia* to 9*la* and 9*ib* to 9*lb*, the registers 9*ia* to 9*la* and 9*ib* to 9*lb* output the data which are currently held.

The selector switch 11*i* sequentially selects the terminals 10, from the one connected to the leftmost output of register 9*ia* to the one connected to the rightmost output of register 9*ib* in synchronization with a divided signal DC which is obtained by dividing the system clock SC by four. The selected data Dii selected by the selector switch 11*i* is inputted to the DFF 12*i* and the DFF 12*i* delays the selected data Dii by one clock of the system clock SC and outputs the delayed data as transfer data Di.

The selector switch 11*j* sequentially selects the terminals 10, from the one connected to the leftmost register output of 9*ja* to the one connected to the rightmost output of register 9*jb* in synchronization with the divided signal DC. The selected data Djj selected by the selector switch 11*j* is inputted to the DFF 12*ja* and the DFF 12*ja* delays the selected data Djj by one clock of the system clock SC and inputs the delayed data to the DFF 12*jb*. The DFF 12*jb* delays the data inputted from the DFF 12*ja* by one clock of the system clock SC and outputs the delayed data as transfer data Dj.

The selector switch 11*k* sequentially selects the terminals 10, from the one connected to the leftmost register output of 9*ka* to the one connected to the rightmost output of register 9*kb* in synchronization with the divided signal DC. The selected data Dkk selected by the selector switch 11*k* is inputted to the DFF 12*ka* and the DFF 12*ka* delays the selected data Dkk by one clock of the system clock SC and inputs the delayed data to the DFF 12*kb*. The DFF 12*kb* delays the data inputted from the DFF 12*ka* by one clock of the system clock SC and inputs the delayed data to the DFF 12*kc*. The DFF 12*kc* delays the data inputted from the DFF 12*kb* by one clock of the system clock SC and outputs the delayed data as transfer data Dk.

The selector switch 11*l* sequentially selects the terminals 10, from the one connected to the leftmost output of register 9*la* to the one connected to the rightmost output of register 9*lb* in synchronization with the divided signal DC. The selected data Dll selected by the selector switch 11*l* is inputted to the DFF 12*la* and the DFF 12*la* delays the selected data Dll by one clock of the system clock SC and inputs the delayed data to the DFF 12*lb*. The DFF 12*lb* delays the data inputted from the DFF 12*la* by one clock of the system clock SC and inputs the delayed data to the DFF 12*lc*. The DFF 12*lc* delays the data inputted from the DFF 12*lb* by one clock of the system clock SC and inputs the delayed data to the DFF 12*ld*. The DFF 12*ld* delays the data inputted from the DFF 12*lc* by one clock of the system clock SC and outputs the delayed data as transfer data Dl.

Through the above operation, the transfer data Dj, Dk and Dl are outputted as data which are obtained by delaying the selected data Djj, Dkk and Dll by two clocks, three clocks and four clocks of the system clock SC, respectively. As a result, the transfer data Di to Dl can be obtained as data which are different in phase from one another by one clock of the system clock SC.

Figure 6:
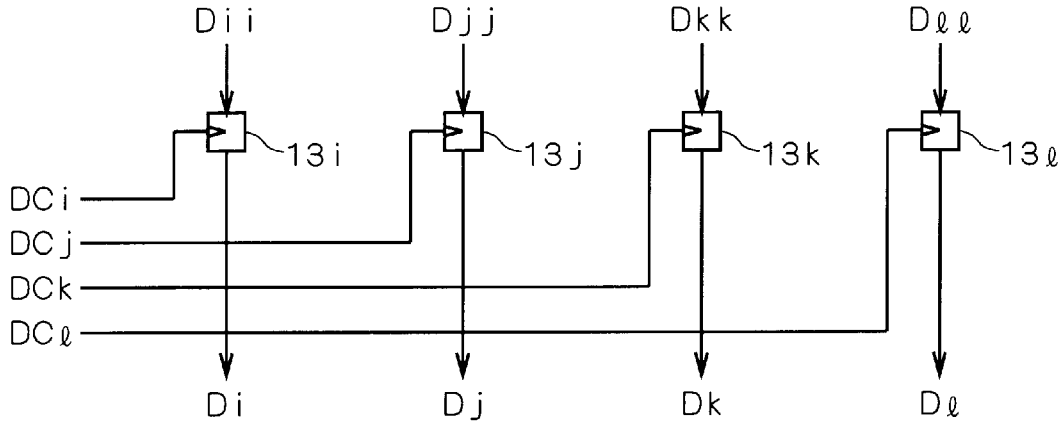
FIG. 6 is a block diagram showing another specific configuration of the signal processing circuit of FIG. 1.

FIG. 6 is a block diagram showing another specific configuration of the signal processing circuit 7 of FIG. 1. In particular, FIG. 6 shows another configuration of the part X boxed by the broken line in FIG. 5. The selected data Dii to Dll are inputted to DFFs 13*i* to 13*l* and the DFFs 13*i* to 13*l* output the transfer data Di to Dl, respectively. The DFFs 13*i* to 13*l* operate in synchronization with the divided clocks DCi to DCl, respectively.

Figure 7:
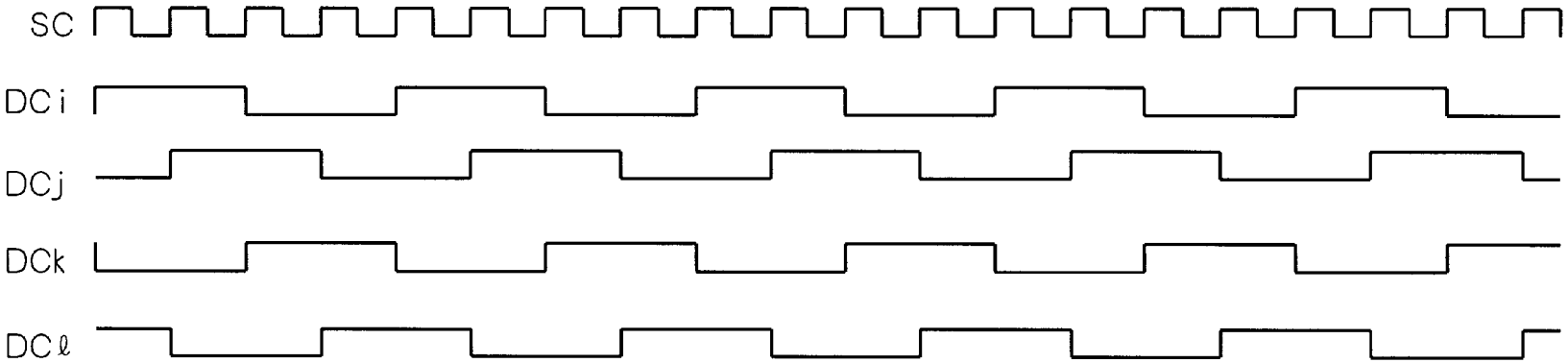
FIG. 7 is a timing chart showing waveforms of a system clock and divided clocks.

FIG. 7 is a timing chart showing waveforms of the system clock SC and the divided clocks DCi to DCl. The divided clocks DCi to DCl are different in phase from one another by one clock of the system clock SC. The divided clocks DCi to DCl can be obtained from the system clock SC in a circuit having a configuration shown in FIG. 8 or 9.

Figure 8:
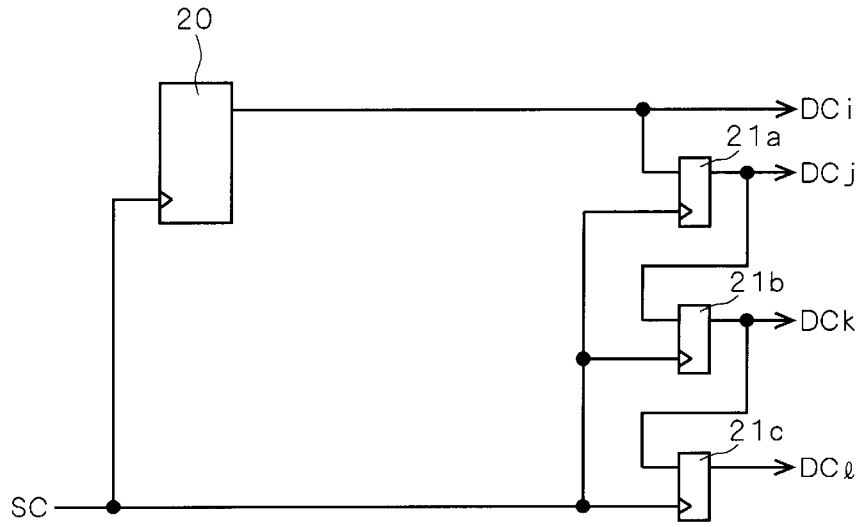
FIG. 8 is a circuit diagram showing a circuit configuration to provide a divided clock on a third preferred embodiment of the present invention.
Figure 9:
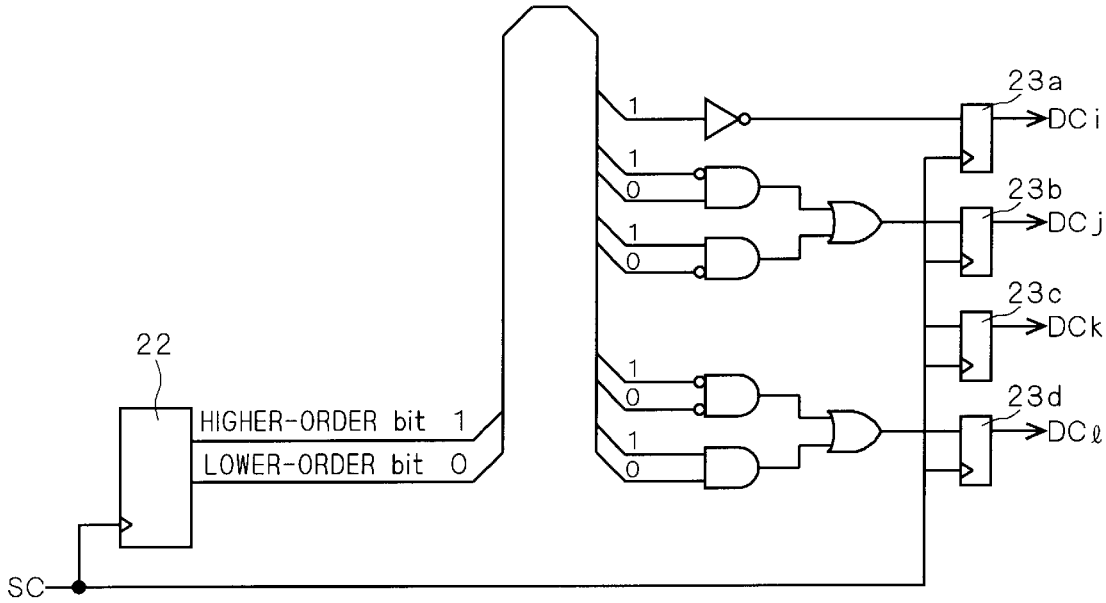
FIG. 9 is a circuit diagram showing another circuit configuration to provide the divided clock on the third preferred embodiment of the present invention.

FIG. 8 shows a four-divider 20 for dividing the system clock SC by four and DFFs 21*a* to 21*c*. The four-divider 20 and the DFFs 21*a* to 21*c* each operate in synchronization with the system clock SC. Further, FIG. 9 shows a binary 2-bit counter 22 and DFFs 23*a* to 23*d*. The binary 2-bit counter 22 and the DFFs 23*a* to 23*d* each operate in synchronization with the system clock SC.

Thus, in the plasma display device of the third preferred embodiment, with a simple configuration using the registers and the DFFs, it is possible to provide the transfer data Di to Dl outputted from the signal processing circuit 7 with their respective phases varied from one to another.

Further, in FIG. 5, by equalizing the number of DFFs connected to the selector switch 11*i* and the number of DFFs connected to the selector switch 11*k*, equalizing the number of DFFs connected to the selector switch 11*j* and the number of DFFs connected to the selector switch 11*l*, and varying the number of DFFs connected to each of the selector switch 11*i* and 11*k* and the number of DFFs connected to each of the selector switch 11*j* and 11*l*, the signal processing circuit 7 in the plasma display device of the second preferred embodiment can be achieved with the same configuration as shown in FIG. 5.

Further, in FIGS. 6 and 7, by equalizing the phases of the divided clocks DCi and DCk, equalizing the phases of the divided clocks DCj and DCl, and varying the phase of the divided clocks DCi and DCk and that of the divided clocks DCj and DCl, the signal processing circuit 7 in the plasma display device of the second preferred embodiment can be achieved with the same configuration as shown in FIG. 6.

The Fourth Preferred Embodiment

Figure 10:
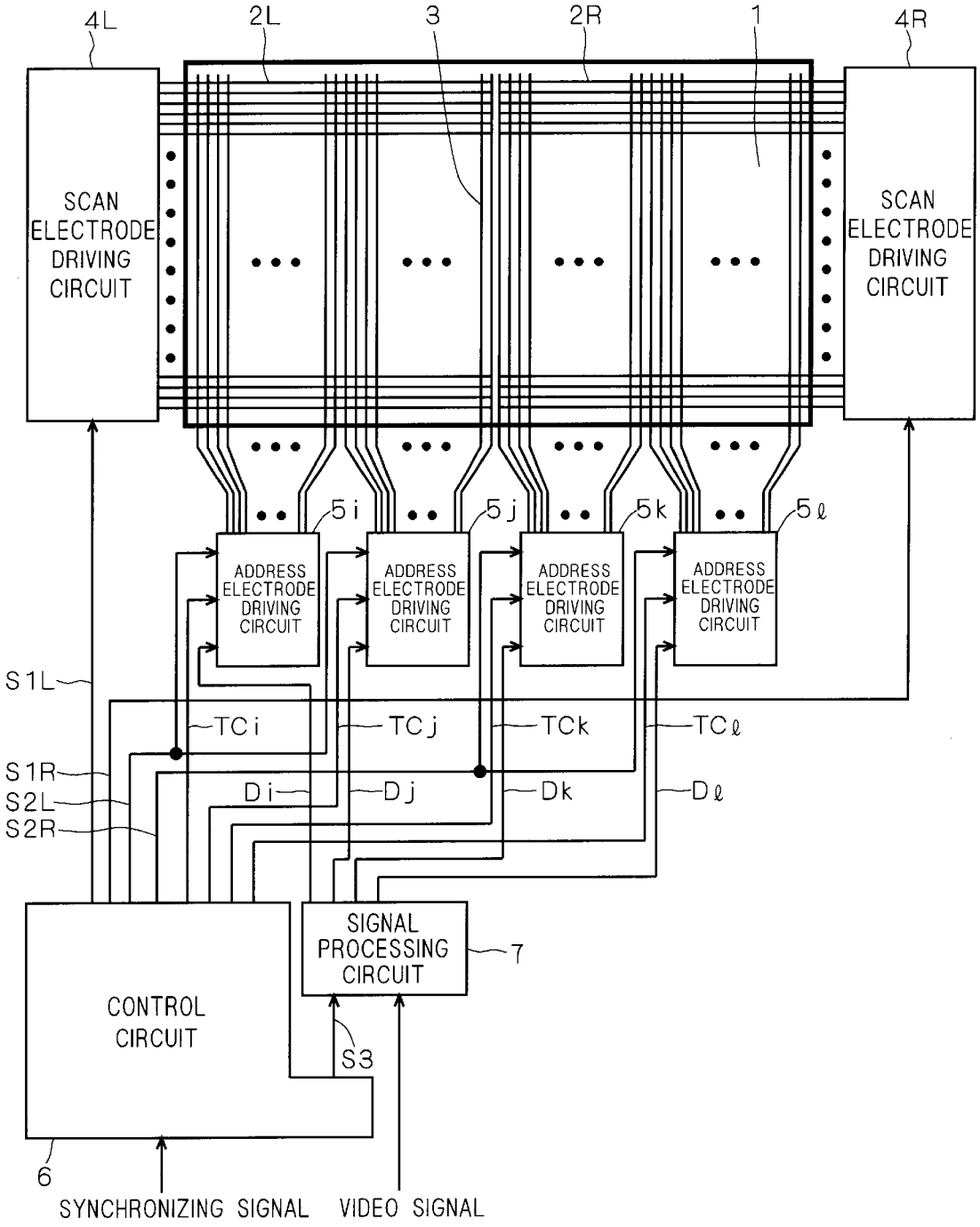
FIG. 10 is a block diagram showing a constitution of a plasma display device in accordance with a fourth preferred embodiment of the present invention.

FIG. 10 is a block diagram showing a constitution of a plasma display device in accordance with the fourth preferred embodiment of the present invention. The scan electrodes 2 are divided into scan electrodes 2L provided in the left-half of the display panel 1, and scan electrodes 2R provided in the right-half of the display panel 1. The scan electrodes 2L are orthogonally to the address electrodes 3 belonging to the leftmost and left-center quarter clusters. And the scan electrodes 2R are orthogonally to the address electrodes 3 belonging to the right-center and rightmost quarter clusters. The scan electrodes 2L are connected to a scan electrode driving circuit 4L and the scan electrodes 2R are connected to a scan electrode driving circuit 4R.

The scan electrode driving circuits 4L and 4R are connected to the control circuit 6, a scan electrode driving control signal S1L is inputted to the scan electrode driving circuit 4L and a scan electrode driving control signal S1R is inputted to the scan electrode driving circuit 4R both from the control circuit 6. Further, a transfer data determination signal S2L is inputted to the address electrode driving circuits 5*i* and 5*j* and a transfer data determination signal S2R is inputted to the address electrode driving circuits 5*k* and 5*l* both from the control circuit 6. Other constitution of the plasma display device in accordance with the fourth preferred embodiment are equivalent to that of the plasma display device in accordance with the first preferred embodiment shown in FIG. 1.

Figure 11:
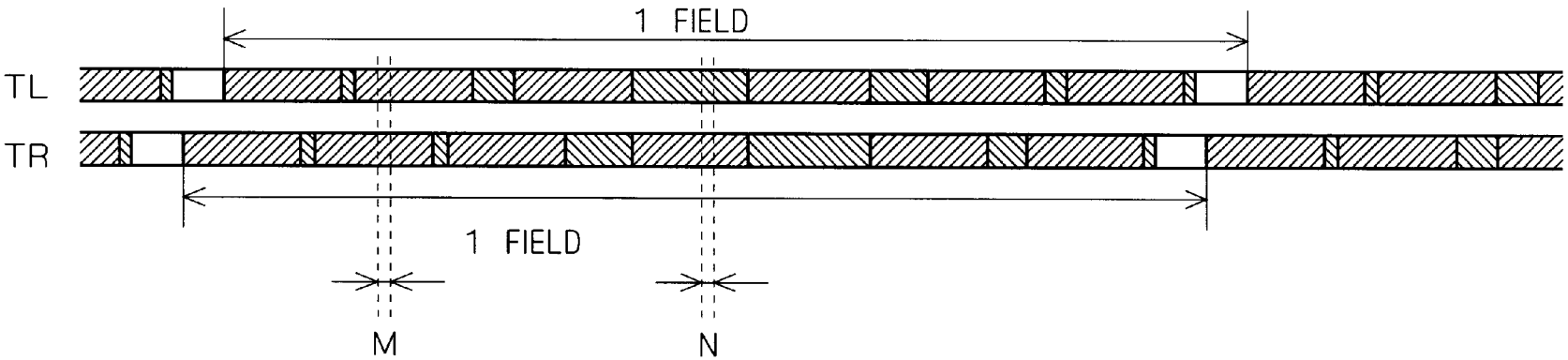
FIG. 11 is a schematic view showing an operating state of the plasma display device in accordance with the fourth preferred embodiment of the present invention.

FIG. 11 is a schematic view showing an operating state of the plasma display device in accordance with the fourth preferred embodiment of the present invention. FIG. 11 shows an operating state TL in the left-half of the display panel 1 and an operating state TR in the right-half of the display panel 1, and the addressing period is hatched downwardly to the left and the discharge sustain period is hatched downwardly to the right. Further, a blank portion not hatched represents a quiescent period. The control circuit 6 controls the output of the scan electrode driving control signals S1L and S1R so that the discharge sustain period of the operation in the left-half of the display panel 1 and that in the right-half of the display panel 1 may not overlap each other, as shown in FIG. 11.

Figure 12:
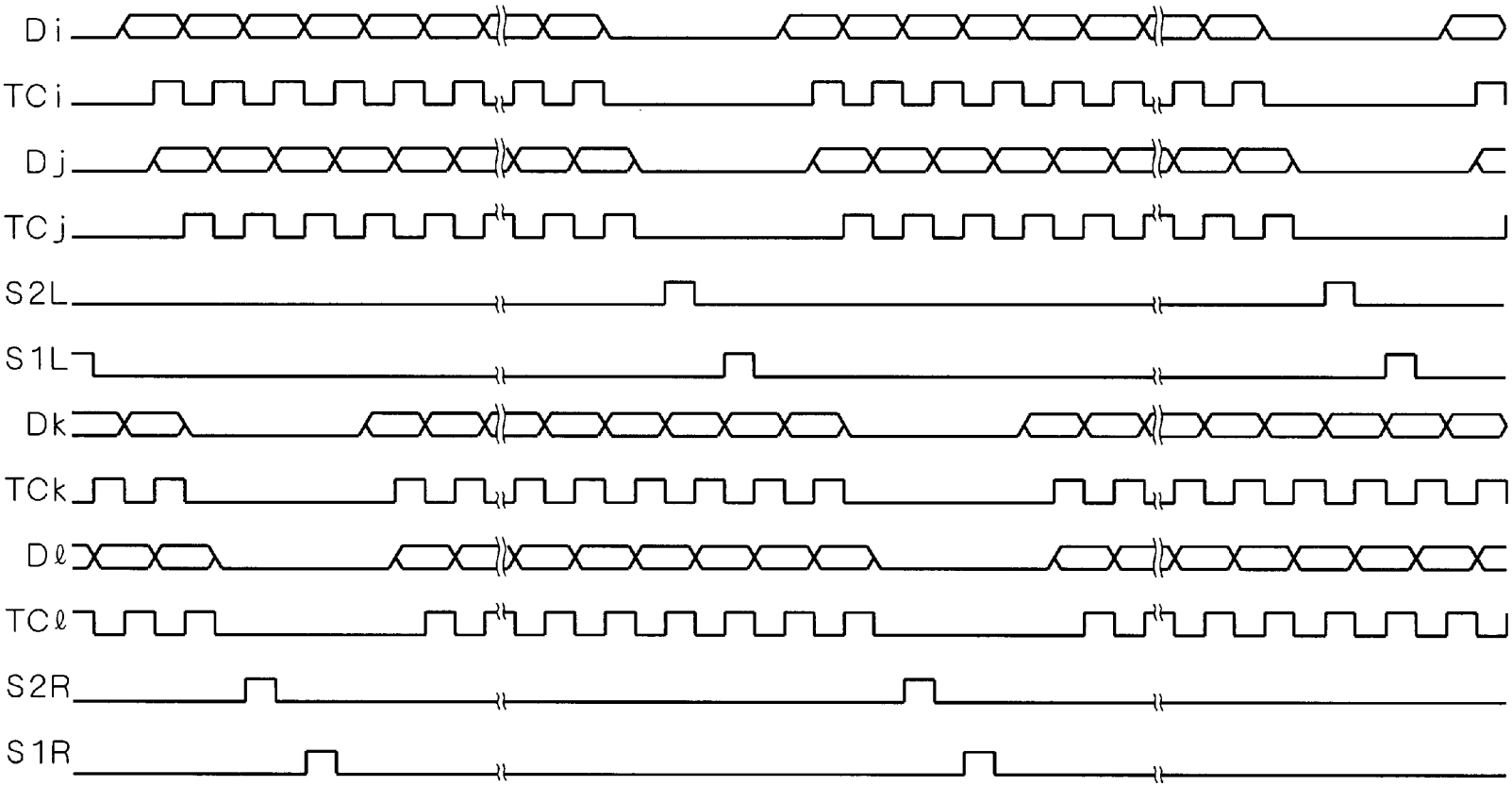
FIG. 12 is a timing chart showing a specific operation in the period M of FIG. 11.

FIG. 12 is a timing chart showing a specific operation in the period M of FIG. 11. In the period M, both the operations in the left-half and right-half of the display panel 1 are addressing operations. At this time, the phases of the transfer data Di and Dj are different from one another, and the phases of the transfer clocks TCi and TCj are also different from one another, like in the first preferred embodiment. And the phases of the transfer data Dk and Dl are different from one another, and the phases of the transfer clock TCk and TCl are also different from one another.

Figure 13:
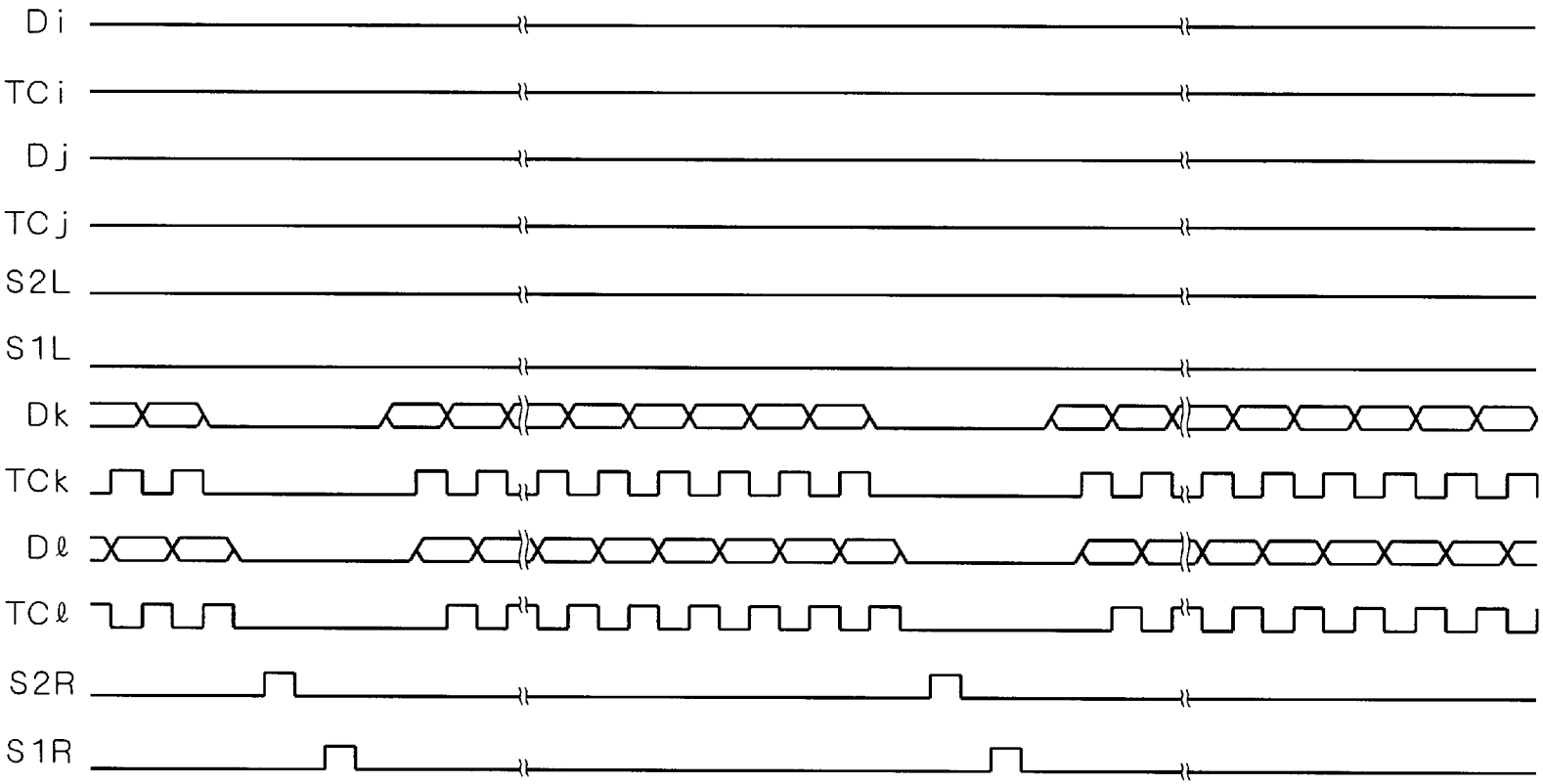
FIG. 13 is a timing chart showing a specific operation in the period N of FIG. 11.
Figure 14:
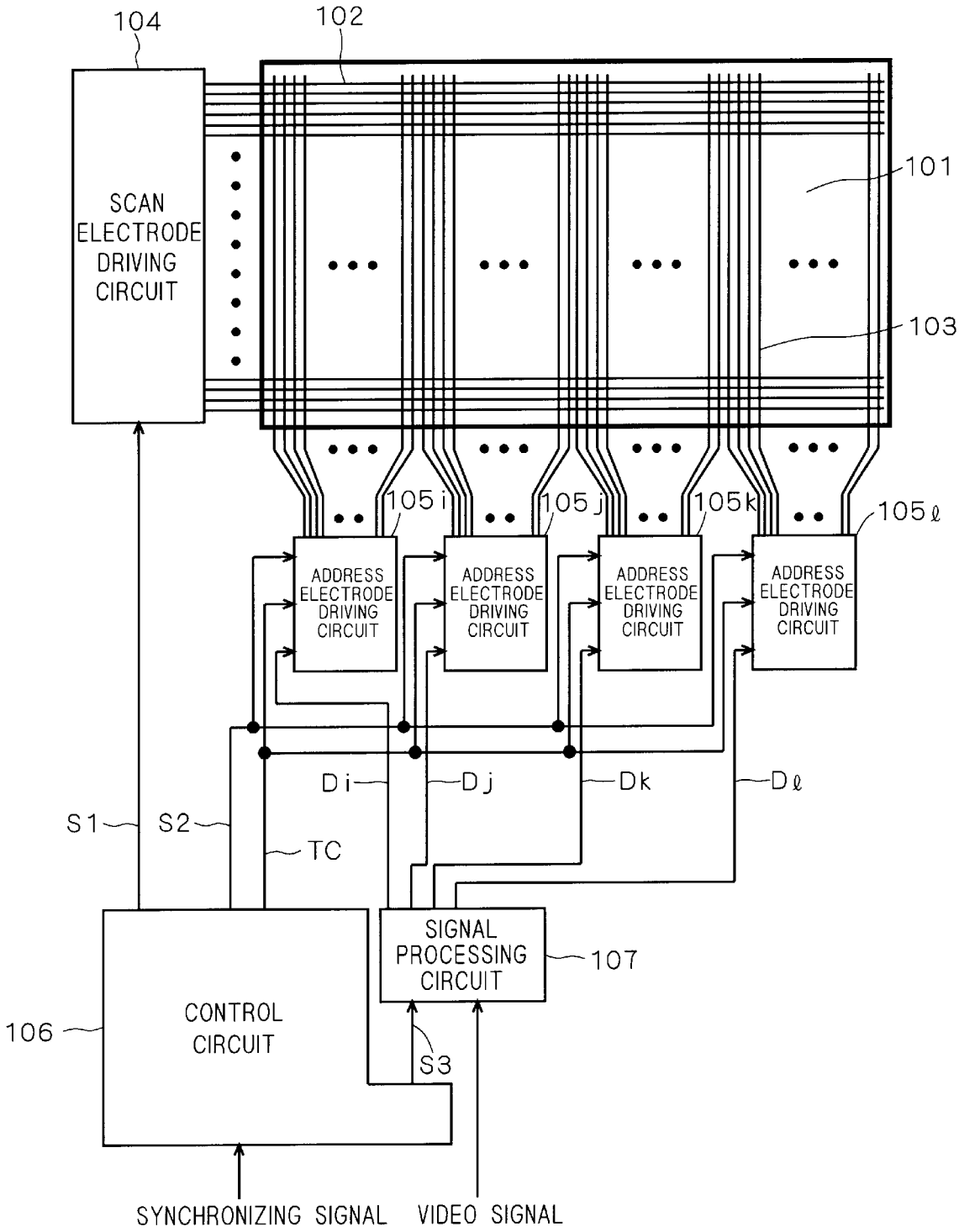
FIG. 14 is a block diagram showing a constitution of a plasma display device in the background art.

FIG. 13 is a timing chart showing a specific operation in the period N of FIG. 11. In the period N, the operation in the left-half of the display panel 1 is a discharge sustain operation and that in the right-half of the display panel 1 is an addressing operation. Therefore, as shown in FIG. 13, the transfer data Di or Dj, the transfer clock TCi or TCj or the like is not transferred in the left-half of the display panel 1.

Thus, in the plasma display device of the fourth preferred embodiment, the discharge sustain operation can disperse most of the power consumption in the plasma display device in the left-half and right-half of the display panel 1. Therefore, it becomes possible to achieve size reduction of a power supply circuit used in the plasma display device and cost reduction.

Further, though the above discussion has been made on the case where the invention of the fourth preferred embodiment is applied to the plasma display device of the first preferred embodiment as a base, the invention of the fourth preferred embodiment can be applied to the plasma display device of the second preferred embodiment shown in FIG. 3 as a base.

Furthermore, though the above discussion has been made on the case where the display panel 1 is divided into two halves, i.e., left half and right half, the position and the number of division are not limited to the above example.

While the invention has been shown and described in detail, the foregoing description is in all aspects illustrative and not restrictive. It is therefore understood that numerous modifications and variations can be devised without departing from the scope of the invention.

What is claimed is:

1. A display device, comprising:

a display panel having a plurality of scan electrodes extending in a first direction and a plurality of address electrodes separated from said plurality of scan electrodes, extending in a second direction perpendicular to said first direction;

a plurality of address electrode driving circuits connected to said plurality of address electrodes; and a signal processing circuit connected to said plurality of address electrode driving circuits, wherein said plurality of address electrodes are divided into a plurality of clusters, said plurality of address electrode driving circuits are provided correspondingly to said plurality of clusters of said address electrodes and include a first and a second address electrode driving circuits, and digital data transmitted from said signal processing circuit to said first address electrode driving circuit and digital data transmitted from said signal processing circuit to said second address electrode driving circuit are different in phase from each other.

2. The display device according to claim 1, wherein said plurality of address electrodes are divided into m (m is an integer, not less than two) clusters, said plurality of address electrode driving circuits are m address electrode driving circuits, and said digital data transmitted from said signal processing circuit to said m address electrode driving circuits are different in phase from one another.

3. The display device according to claim 1, wherein said plurality of address electrodes are divided into m (m is an integer, not less than two) clusters, said plurality of address electrode driving circuits are m address electrode driving circuits, said m address electrode driving circuits are divided into n (n is an integer, not less than two and not more than m−1) groups, and said digital data inputted to one or a plurality of address electrode driving circuits belonging to same group are equivalent in phase to one another and said digital data inputted to a plurality of address electrode driving circuits belonging to different groups are different in phase from one another.

4. The display device according to claim 1, wherein said signal processing circuit has a first register temporarily storing first digital data transmitted to said first address electrode driving circuit;

a second register temporarily storing second digital data transmitted to said second address electrode driving circuit;

a first delay element for delaying said first digital data outputted from said first register by a predetermined time and inputting said first digital data into said first address electrode driving circuit; and a second delay element for delaying said second digital data outputted from said second register by a time different from said predetermined time and inputting said second digital data into said second address electrode driving circuit.

5. The display device according to claim 1, wherein said plurality of scan electrodes include a plurality of first scan electrodes provided in a first region of said display panel and a plurality of second scan electrodes provided in a second region of said display panel, said display device further comprising:

a first scan electrode driving circuit connected to said plurality of first scan electrodes;

a second scan electrode driving circuit connected to said plurality of second scan electrodes; and a control circuit connected to said first and second scan electrode driving circuits, wherein an addressing period during which an addressing operation is performed to select a cell which should be illuminated and a discharge sustain period during which a discharge for luminescence is generated on said cell which is selected by said addressing operation are repeated to perform a display operation in one field of display, and said discharge sustain period for said display operation in said first region and said discharge sustain period for said display operation in said second region do not overlap each other by said control circuit controlling said first and second scan electrode driving circuits.

6. The display device according to claim 1, wherein said display device is a plasma display device.

7. A display device, comprising:

a display panel having a plurality of first scan electrodes extending in a first direction in a first region of said display panel, a plurality of second scan electrodes extending in said first direction in a second region of said display panel and a plurality of address electrodes separated from said plurality of first and second scan electrodes, extending in a second direction perpendicular to said first direction;

a first scan electrode driving circuit connected to said plurality of first scan electrodes;

a second scan electrode driving circuit connected to said plurality of second scan electrodes; and a control circuit connected to said first and second scan electrode driving circuits, wherein an addressing period during which an addressing operation is performed to select a cell which should be illuminated and a discharge sustain period during which a discharge for luminescence is generated on said cell which is selected by said addressing operation are repeated to perform a display operation in one field of display, and said discharge sustain period for said display operation in said first region and said discharge sustain period for said display operation in said second region do not overlap each other by said control circuit controlling said first and second scan electrode driving circuits.

8. The display device according to claim 7, wherein said display device is a plasma display device.

9. A display device, comprising:

a display panel having a plurality of scan electrodes extending in a first direction and a plurality of address electrodes extending in a second direction, wherein said first and second directions are non-parallel and wherein said plurality of address electrodes are divided into m (greater than or equal to 2) address electrode clusters;

at least one scan electrode driving circuit connected to said plurality of scan electrodes;

m address electrode driving circuits, wherein each address electrode driving circuit is connected to said address electrodes of a corresponding address electrode cluster; and a signal processing circuit connected to each of said m address electrode driving circuits to supply each address driving circuit with corresponding digital data, wherein phases of said digital data to at least two address electrode driving circuits are different from each other.

10. The display device of claim 9, wherein:

said m address electrode clusters are divided into n (greater than or equal to 2, less than m) groups;

each address electrode driving circuit belongs to one of said n groups; and said phases of said digital data to at least two groups of address electrode driving circuits are different from each other.

11. The display device of claim 10, wherein no two address electrode clusters of a same group are adjacent to each other.

12. The display device of claim 9, wherein:

said signal processing circuit comprises m delay elements; and each delay element is connected to said corresponding address electrode driving circuit such that said corresponding digital data are each delayed a corresponding predetermined period of time.

13. The display device of claim 12, wherein the m delay elements are configured as one of the following:

each corresponding delay element comprises one or more unit delay elements serially connected, a number of unit delay elements for each delay element is different from each other, and all unit delay elements are configured to be driven by a common clock;

each corresponding delay element comprises a single unit delay element and each unit delay element is driven by a corresponding data clock;

m unit delay elements serially connected and driven by said common clock with outputs of each unit delay element serving as said corresponding delay element output; and a logic circuit with m outputs, said logic circuit including a binary counter and m unit delay elements, wherein said outputs of said logic circuit are driven by a common clock.

14. The display device of claim 13, wherein the unit delay element is a digital flip flop.

15. The display device of claim 9, wherein:

said plurality of scan electrodes are divided into k (greater than or equal to 2) scan electrode clusters;

a number of scan electrode driving circuit equals k and each scan electrode driving circuits is connected to scan electrodes of a corresponding scan electrode cluster; and said scan electrode circuits are configured such that discharge sustain periods for at least two scan electrode clusters do not overlap each other.

16. The display device of claim 15, wherein said scan electrode driving circuits are configured such that none of said discharge sustain periods overlap each other.

17. A display device, comprising:

a display panel having a plurality of scan electrodes extending in a first direction and a plurality of address electrodes extending in a second direction, wherein said first and second directions are non-parallel and wherein said plurality of scan electrodes are divided into k (greater than or equal to 2) scan electrode clusters;

at least one electrode driving circuit connected said plurality of address electrodes; and k scan electrode driving circuits, wherein each scan electrode driving circuit is connected to scan electrodes of a corresponding scan electrode cluster and wherein said k scan electrode driving circuits are configured such that discharge sustain periods for at least two scan electrode clusters do not overlap each other.

18. The display device of claim 17, wherein said scan electrode driving circuits are configured such that none of said discharge sustain periods overlap each other.

* * * * *